United States Patent [19]

Walkhoff

[11] Patent Number: 5,065,481

[45] Date of Patent: Nov. 19, 1991

[54] CLAMPING DEVICE FOR A SKI BOOT

[75] Inventor: Klaus Walkhoff, Kreuzlingen, Switzerland

[73] Assignee: Raichle Sportschuh AG, Kreuzlingen, Switzerland

[21] Appl. No.: 588,442

[22] Filed: Sep. 24, 1990

[30] Foreign Application Priority Data

Sep. 26, 1989 [CH] Switzerland ..... 03483/89

[51] Int. Cl.[5] ..... A43C 11/00

[52] U.S. Cl. ..... 24/68 SK; 24/71.2; 36/50

[58] Field of Search ..... 24/68 R, 68 SK, 69 SK, 24/76 SK, 71 SK, 71.2; 36/50

[56] References Cited

U.S. PATENT DOCUMENTS

| | | | |
|---|---|---|---|
| 4,631,839 | 12/1986 | Bonetti et al. | 36/50 |
| 4,719,650 | 1/1988 | Kurt | 24/71.2 |
| 4,727,627 | 3/1988 | Baggio et al. | 24/71 SK X |
| 4,814,649 | 6/1989 | Baggio et al. . | |
| 4,870,723 | 10/1989 | Pozzobon et al. | 36/50 X |
| 4,961,544 | 10/1990 | Bidoia | 36/50 X |

FOREIGN PATENT DOCUMENTS 0247487 12/1987 European Pat. Off. .

0255869 2/1988 European Pat. Off. .

*Primary Examiner*—James R. Brittain

*Attorney, Agent, or Firm*—Collard, Roe & Galgano

[57] ABSTRACT

The shank of the clamping device is connected to the actuating element via a freewheel and is supported on the cover via a counteracting further freewheel. Located on the shank fixedly in the terms of rotation and displacement is the first coupling part which interacts with a second coupling part mounted at a fixed location. The latter is connected to the winding-up element for the clamping cables via a bevel gear. Formed on the actuating element is a slot-shaped groove which slides along the fixed guide pin during the pivoting of the actuating element. For tensioning the clamping cables, the actuating element is pivoted in such a way that the groove part is located at the guide pine. The shank is thereby lifted into the upper clamping position and the coupling is closed. During the pivoting of the actuating element to and fro, the clamping cables are wound onto the winding-up element. To release the clamping cables, the actuating element is pivoted in such a way that the groove part is located at the guide pin. The shank is thereby lowered into the lower release position, the first coupling part separating from the second coupling part. The winding-up element is thereby freely rotatable.

10 Claims, 6 Drawing Sheets

CLAMPING DEVICE FOR A SKI BOOT

BACKGROUND OF THE INVENTION

1. Field of the Invention

The present invention relates to a clamping device for a ski boot with a rotatably mounted wind-up element.

2. The Prior Art

A clamping device of this type is known, for example, from FR-A-2,561,878 or the corresponding U.S. Pat. No. 4,631,839. A winding-up element for the winding up and unwinding of a band-shaped clamping element and a transmission member equiaxial with this are releasably connected to one another by means of a gear wheel. The transmission member is fixedly guided in terms of rotation, but axially displaceably, in a cylinder body rotatably mounted at a fixed location. Using a take-up connection rotatable in the winding-up direction of the winding-up element, the cylinder body is connected to a bearing element which is rotatably mounted in a housing about the axis of the winding-up element and of the clamping element. A lever-shaped actuating element is arranged on the bearing element pivotably about a shaft extending at right angles to this axis and intersecting the latter. The cylinder body and therefore the transmission member are prevented from rotating oppositely to the winding-up direction by means of a return catch device. A spring presses the transmission member in the opening direction of the coupling against the actuating element which is designed in the form of an eccentric on its periphery in the region of the shaft. For winding up the clamping element, the actuating element is pivoted through 90 degrees about the shaft out of its rest position, it bears against the housing of the clamping device, so that it extends approximately in the radial direction in relation to the axis of rotation of the transmission member and of the winding-up element. The coupling with the transmission member and the winding-up element is thus always kept closed, since the periphery of the actuating element is made cylindrical in the region corresponding to the shaft. Now the actuating element is pivoted to and fro within a working pivot range, with the result that the winding-up element is driven intermittently in the winding-up direction. If the clamping element has the desired tension, the actuating element is pivoted back into the rest position, and the coupling remains in engagement and therefore the tension in the clamping element is maintained. Now when the clamping device is to be released, the actuating element is pivoted out of the rest through 180 degrees about the shaft. The result is that the transmission member is displaceable in the direction of its axis of rotation under the force of the spring, since the distance between the periphery of the actuating element, against which the transmission member bears, and the shaft decreases during the second half of this pivoting movement. The coupling is thereby opened and the winding-up element is released for rotating in the unwinding direction. This known clamping device is complicated in terms of both its construction and its operation.

A further clamping device with a rotatably mounted winding-up element for the winding up and unwinding of a cable-shaped clamping element is known from FR-A-2,593,682 or the corresponding U.S. Pat. No. 4,719,670. There projects on one side from the drum-shaped winding-up element a shaft, on which an essentially hollow-cylindrical transmission member is located and is freely rotatable. This is prevented from rotating oppositely to the winding-up direction by means of a return catch device. In the region facing the winding-up element, the transmission member is made disk-shaped and has a recess into which a pin projecting from the winding-up element engages. On the side facing away from the winding-up element, the transmission member is likewise made disk-shaped and has a further recess. This interacts with a driving nose of a bearing part, on which an actuating element is arranged pivotably about an axis at right angles to the axis of rotation of the winding-up element and intersecting this. During the rotation of the actuating element in the winding-up direction, the transmission member is taken up by the driving nose and the winding-up element by the pin engaging in the recess of the transmission member. When the actuating element is moved oppositely to the winding-up direction, the transmission member and therefore the winding-up element are prevented from corotating in this direction by the return catch device, the driving nose coming out of engagement with the corresponding recess. To release the clamping device, the shaft and therefore the winding-up element are pressed downwards, for example by means of the ski pole, with the result that the pin comes out of engagement with the corresponding recess in the transmission member. The winding-up element is thereby released. A disadvantage of this clamping device is that a tool, for example the ski stick, is necessary for the release.

A further clamping device is known, for example, from U.S. Pat. No. 4,433,456. This has a drum-shaped winding-up element for the winding up and unwinding of two clamping cables, which is permanently connected operatively to a transmission member via a gear having teeth. The transmission member and therefore the winding-up element are releasably prevented from rotating oppositely to the winding-up direction by means of a disconnectable return catch device. Located as a nut on a thread on the transmission member is an actuating element which, during rotation in the winding-up direction, runs axially onto a take-up stop on the transmission member and drives the transmission member or the winding-up element in the winding-up direction. For unwinding the clamping cables, the actuating element is rotated oppositely to the winding-up direction, the latter moving away from the take-up stop in the axial direction of the transmission member and having a releasing effect on the return catch device. The transmission member and, therefore, the winding up element are thereby released for unwinding the clamping cables. Now a disadvantage of this known clamping device is that, in order to release the winding-up element so as to unwind the clamping cables, the actuating element has to be rotated through a large angle. It is necessary, furthermore, in order to unwind the clamping cables, for the actuating element to be corotated in the unwinding direction, otherwise the return catch device is activated again as a result of the rotation of the transmission member in relation to the actuating element and a further unwinding of the clamping cables is, thus, prevented.

A further clamping device is known from EP-A-0,255,869. This likewise has a drum-shaped winding-up element for the winding up and unwinding of clamping cables, which is permanently connected operatively to a transmission member via a Maltese-cross, toothed or planetary gear. A two-armed catch lever is pivotably mounted on the transmission member by means of one lever arm so as to be prestressed towards a catch toothing on the housing of the clamping device. The other lever arm engages into a control cam of an actuating element connected via a take-up connection which, during the change of the direction of rotation of the actuating element, allows an idling pivot angle of the actuating element in relation to the transmission member. During the rotation of the actuating element in the winding-up direction, the control cam releases the catch lever and the take-up connection takes up the transmission member and, therefore, the winding-up element in the winding-up direction. The catch lever engaging into the catch toothing prevents the transmission member and, therefore, the winding up element from rotating oppositely to the winding-up direction. For unwinding the clamping cables, the actuating element is rotated oppositely to the winding-up direction, with the result that the control cam now releases the catch lever from the catch toothing and the take-up connection takes up the transmission member and, therefore, the winding-up element in the unwinding direction. In this clamping device, admittedly a rotation of the actuating element through a smaller angle is necessary for releasing the catch lever. But for unwinding the clamping cables, the actuating element has to be corotated continuously in the unwinding direction, otherwise the control cam releases the catch lever again and, thus, prevents a further release of the clamping cables.

SUMMARY OF THE INVENTION

It is an object of the present invention to provide a clamping device for a ski boot which is space-saving and which is simple in terms of its construction and operation.

The clamping device is operated as a result of the pivoting of the actuating element about a single axis. This simplifies the construction and increases the ease of operation.

Preferably, the return catch device has a free-wheel active in the winding-up direction. A virtually continuous tensioning of the clamping element thereby becomes possible, since freewheels engage immediately when the direction of rotation of the transmission member is changed.

A desirable embodiment is the clamping device wherein the transmission member has a longitudinal axis; wherein the winding-up element has an axis of rotation; wherein the longitudinal axis of the transmission member and the axis of rotation of the winding-up element intersect one another approximately at right angles; the second coupling part is located freely rotatably on the transmission member; and there is a bevel gear for connecting the second coupling part to the winding-up element.

An especially preferred embodiment of the clamping device is where the coupling is releasable as a result of the displacement of the transmission member in the axial direction. This makes it unnecessary to have a special actuating member for releasing the coupling.

The above objects are accomplished in accordance with the present invention by providing a clamping device for a ski boot comprising a clamping element; a rotatably mounted winding-up element for the winding-up and unwinding of the clamping element; an actuating element pivotable to and fro within a working pivot range for the intermittent driving of the winding-up element in the winding-up direction; a take-up connection rotatable in the winding-up direction for connecting the actuating element to a transmission member; a return catch device for preventing the transmission member from rotating oppositely to the winding-up direction; a coupling for connecting the transmission member to the winding-up element and controllable as a result of the displacement of the transmission member; the transmission member being displaceable as a result of a pivoting of the actuating member for the purpose of releasing the coupling; a slotted control; the actuating element during the pivoting out of the working pivot range oppositely to the winding-up direction, is movable by the slotted control in the direction of its pivot axis; and the transmission member being displaceable as a result of this movement oppositely to the winding-up direction for the release of the coupling.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawing wherein similar reference characters denote similar elements throughout the several views.

DETAILED DESCRIPTION OF THE PREFERRED EMBODIMENT

Figure 1:
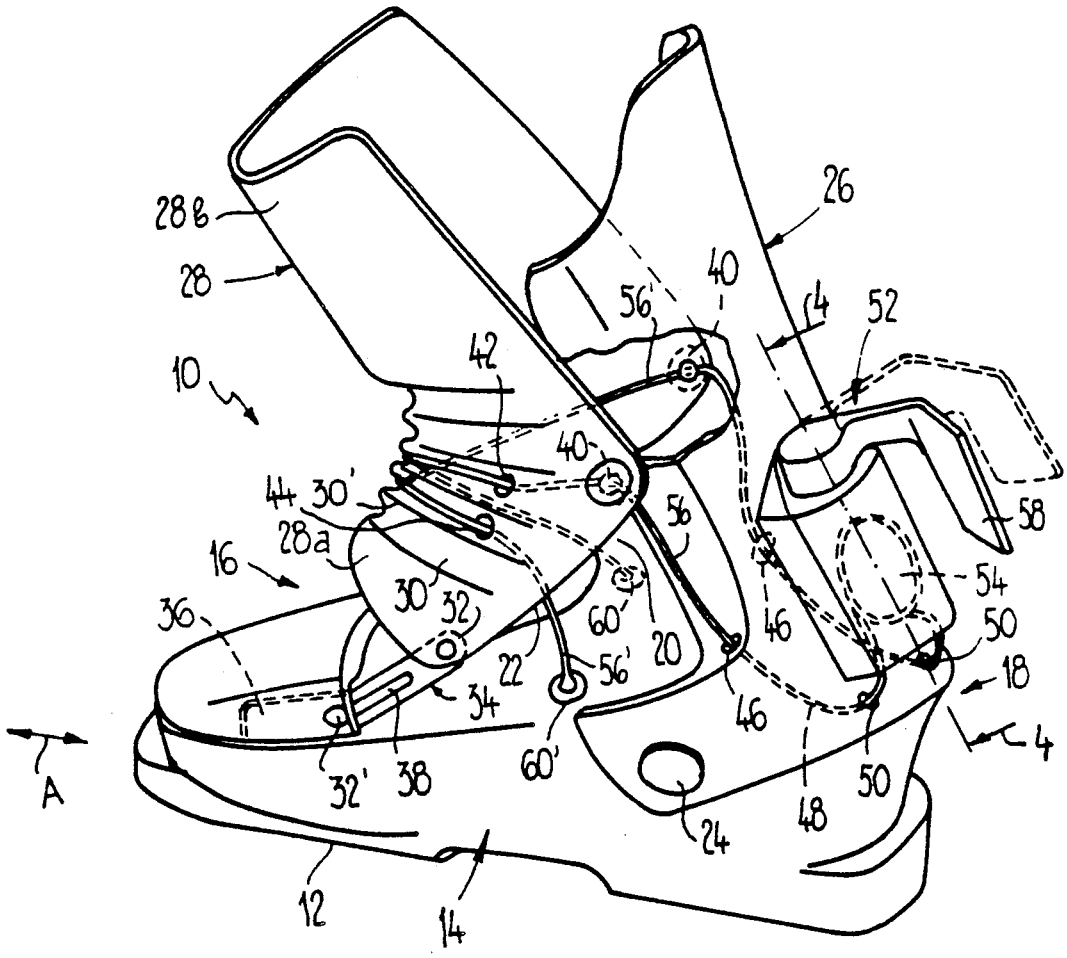
FIG. 1 shows a perspective view of an open ski boot.
Figure 2:
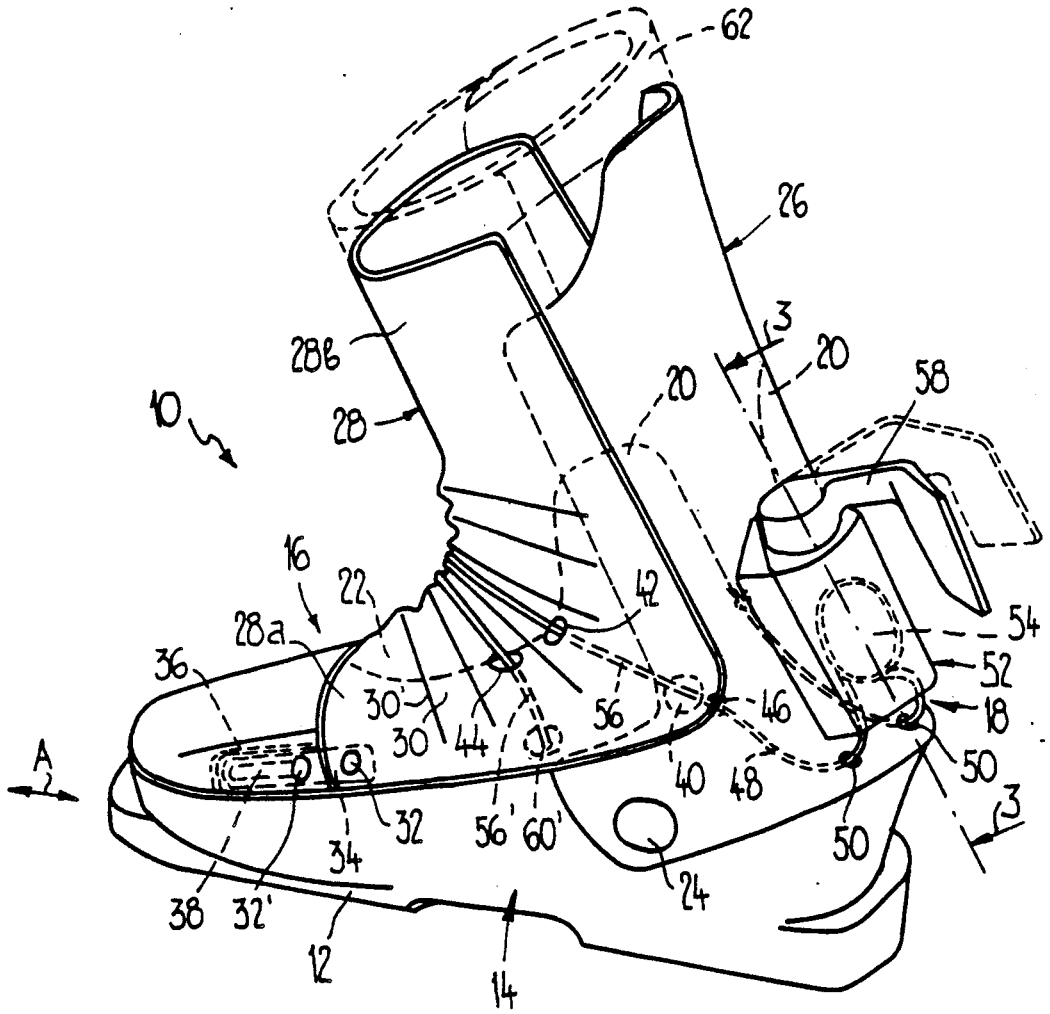
FIG. 2 shows a perspective view of a closed ski boot.

The plastic shell 10 of the ski boot illustrated in FIGS. 1 and 2 has a shell part 14 equipped with a sole 12. This shell part encloses the skier's foot in the toe and instep region 16 and in the lower heel region 18 and possesses two lateral tabs 20 projecting upwards in the ankle region. On its front side, a cutout 22 is provided on the shell part 14 in the region of the instep.

Fastened to the shell part 14 in the region of the heel bone by means of a joint 24 is a heel part 26. This surrounds the lower rear leg region between the lower heel region and the calf and engages laterally over the upwardly projecting tabs 20 of the shell part 14. When the lower leg bends forwards, the heel part 26 is forwardly pivotable out of the rest position shown in the figures by means of an axis defined by the joint 24. This axis extends parallel to the sole 12 and at right angles to the longitudinal mid-plane of the boot. The position of rest of the heel part 26 corresponds to the normal posture of the lower leg during skiing.

Furthermore, the shell 10 possesses a tongue part 28 covering the instep/shin region 16, with a portion 28*a* covering the instep region and with a portion 28*b* covering the lower shin region. The tongue part 28 is of waveshape construction in the portion 28a and in the transitional region between the two portions 28a and 28b, the wave troughs 30 and wave crests 30' extending from one side of the ski boot to the other. The tongue part 28, in its rear end regions, overlaps the heel part 26.

The tongue part 28, in each of its two front lateral corner regions, is articulated pivotably on a strap 34 in each case, by means of rivets 32. The two straps 34, of which only one is visible in each of FIGS. 1 and 2, project forward from the tongue part 28 and are guided displaceably approximately in the longitudinal direction A of the boot in corresponding pockets 36. The straps 34, in their region projecting from the tongue part 28, having guide slots 38 which extend in their longitudinal extension and through each of which extends a further rivet 32'. The rivet 32' is arranged on the shell part 14 in the open end region of the pockets 36. When the straps 34 are pulled out rearwards in the longitudinal direction A of the boot until the guide slots 38 butt against the rivets 32', these straps 34 are pivotable about the rivets 32', as shown in FIG. 1. In this position of the straps 34, the tongue part 28 is also in its rear end position. In contrast, when the straps 34 are pushed forwards partially or completely into the pockets 36 in the longitudinal direction A of the boot, they are guided so as to be displaceable in the longitudinal direction of the pockets 36 and are no longer pivotable about the axis determined by the rivets 32' and extending approximately parallel to the sole 12 and at right angles to the longitudinal mid-plane of the boot (see FIG. 2). However, independently of the position of the straps 34, the tongue part 28 is pivotable on these about the axis determined by the rivets 32 and extending essentially parallel to the sole 12 and transversely relative to the longitudinal mid-plane of the boot.

A guide eyelet 40 is freely rotatably mounted on the tongue part 28 in each of the lateral rear corner regions at the transition from the portion 28a to the portion 28b. Approximately centrally between each of these guide eyelets 40 and the longitudinal mid-plane of the boot, the tongue 28 has a passage 42 in the transitional region between the portions 28a and 28b, these two passages 42 being located in the same wave trough 30. Two further passages 44 are provided in the next wave trough 30 forward in the longitudinal direction A of the boot in relation to these passages 42.

The heel part 26 has, above the joint 24 and offset rearward, as seen in the longitudinal direction A of the boot, on each of the two sides a guide orifice 46, from which a diagrammatically indicated guide channel 48 extends, inside the heel part 26, into the rear lower end region of the heel part 26. The corresponding orifices at this end of the guide channels 48 are designated by 50. Above the orifices 50, a clamping device 52 with a drum-shaped winding-up element 54 for two clamping cables 56 and 56' is provided on the heel part 26. The clamping device 52 possesses a toggle-shaped actuating element 58 pivotable to and fro about an axis extending in the longitudinal mid-plane of the boot and parallel to the heel part 26. This clamping device 52 is described in detail further below. For an understanding of FIGS. 1 and 2, it is sufficient to know that by pivoting the actuating element 58 to and fro (see dotted lines) within a working pivot range B (see FIG. 6) the clamping cables 56, 56' are intermittently wound onto the winding-up element 54, and by pivoting the actuating element 58 out of the working pivot range opposite to the winding-up direction the winding-up element 54 can be released in order to loosen the clamping cables 56, 56'.

The clamping cable 56 extends from the winding-up element 54 to the orifice 50 and through the corresponding guide channel 48 to the guide orifice 46, from this to the respective guide eyelet 40 on the tongue part 28 and underneath the tongue part 28 to the passage 42, from where the clamping cable 56 extends on the outside of the tongue part 28 in the wave trough 30 over the instep/shin region to the passageway 42 located opposite in relation to the longitudinal mid-plane of the boot. There, the clamping cable 56 once again penetrates through the tongue part 28 and extends underneath this to a fastening point 60 on the shell part 14, where this end of the clamping cable 56 is anchored firmly. The other clamping cable 56 extends accordingly from the clamping device 52 through the corresponding guide channel 48 to the guide orifice 46, from this to the guide eyelet 40 and underneath the tongue part 28 to the passage 44. Between the two passages 44, the clamping cable 56' extends parallel to the clamping cable 56 in the adjacent wave trough 30 and with this end is fastened to the shell part 14 at the fastening point 60' in a corresponding way. The two fastening points 60, 60' are located opposite one another in relation to the longitudinal mid-plane of the boot and, as seen in the longitudinal direction A of the boot, are arranged on the shell part 14 so as to be offset forwards relative to the guide orifices 46. When the tongue part 28 bears on the shell part 14, the fastening points 60, 60' are covered by this.

As indicated by broken lines in FIG. 2, the gap between the shell 10 and the wearer's foot is filled in a way known per se with a soft padded inshoe 62.

When the tongue part 28 is opened, as shown in FIG. 1, the ski boot can be entered. Solely by pivoting the actuating element 58 to and fro, the two clamping cables 56, 56' are now wound on to the winding-up element 54, with the result that the tongue part 28 is pulled in the direction of the sole 14. At the same time, the straps 34 pivot about the respective rivet 32' in the clockwise direction until the longitudinal extension of the straps 34 extends in the direction of the pockets 36. By a further tightening of the clamping cables 56, 56', the tongue part 28 is pushed forwards in the longitudinal direction A of the boot, at the same time, executing a pivot movement in the clockwise direction, with the result that the straps 34 slide deeper into the pockets 36. The front end region of that portion 28a of the tongue part 28 covering the instep is thereby held on the shell part 14 in a precisely defined way. When the tightening force in the clamping cables 56, 56' is increased further, the tongue part 28 is brought to bear flush on the shell part 14, the guide eyelets 40 coming to rest in the region of the guide orifices 46 in the heel region 18 (see FIG. 2).

Because the tongue part 28 is mounted freely in the longitudinal direction A of the boot and pivotably by means of the rivets 32, it can be matched to the anatomy of the wearer's foot or lower leg region as a result of the deformation of the shell part 14. At the same time, particularly the guidance of the clamping cables 56, 56' in the region of the tongue part 28 and the high clamping force of the clamping device 52 ensure the best possible matching of the shell 10 to the particular individual foot shape of the skier as a result of a cross-sectional variation of the ski boot in the region covered by the tongue part 28. The high tension achieved thereby in the clamping cables 56, 56' provides the saddle-shaped tongue part 28 in the region of the guide eyelets 40 with a virtual joint, thus serving for obtaining a snugger guidance of the portion 28*b* covering the lower shin region during the torsial flexing movement of the lower leg. Moreover, during this flexible movement, as a result of the guidance of the clamping cables 56, 56' from the heel part 26 to the tongue part 28 above the joints 24, the heel part 26 is also pulled forwards in a pivoting movement, and in this situation, too, this gives the skier a firm hold in the ski boot. It must be remembered that, when the ski boot is being closed, the clamping cables 56, 56' serve as guide strands for the positive closing movement of the tongue part 28.

To open the ski boot, the actuating element 58 is brought outside the working pivot range opposite to the clamping direction, with the result that the winding-up element 54 is released. The high tension in the clamping cables 56, 56' is thereby reduced immediately, and it becomes possible for the wound-up portion of the clamping cables 56, 56' to unwind during the forward pivoting of the tongue part 28. When the tongue part 28 is pivoting forwards this way, the straps 34 slide rearwards in the pockets 36 in the longitudinal direction A of the boot, since the tongue part 28 rests with its front end against the shell part 14 in the region of the longitudinal mid-plane of the boot. The tongue part 28 is thereby brought into the position shown in FIG. 1.

A clamping device which is especially suitable for the ski boot described and can exert the necessary high tightening forces in the clamping cables 56, 56', without the wearer of the ski boot expending a large amount of force on the actuating element 58, but which nevertheless allows long lengths of the clamping cables 56, 56' to be wound up by means of only a few pivoting strokes of the actuating element 58, is now described in more detail below.

Figure 3:
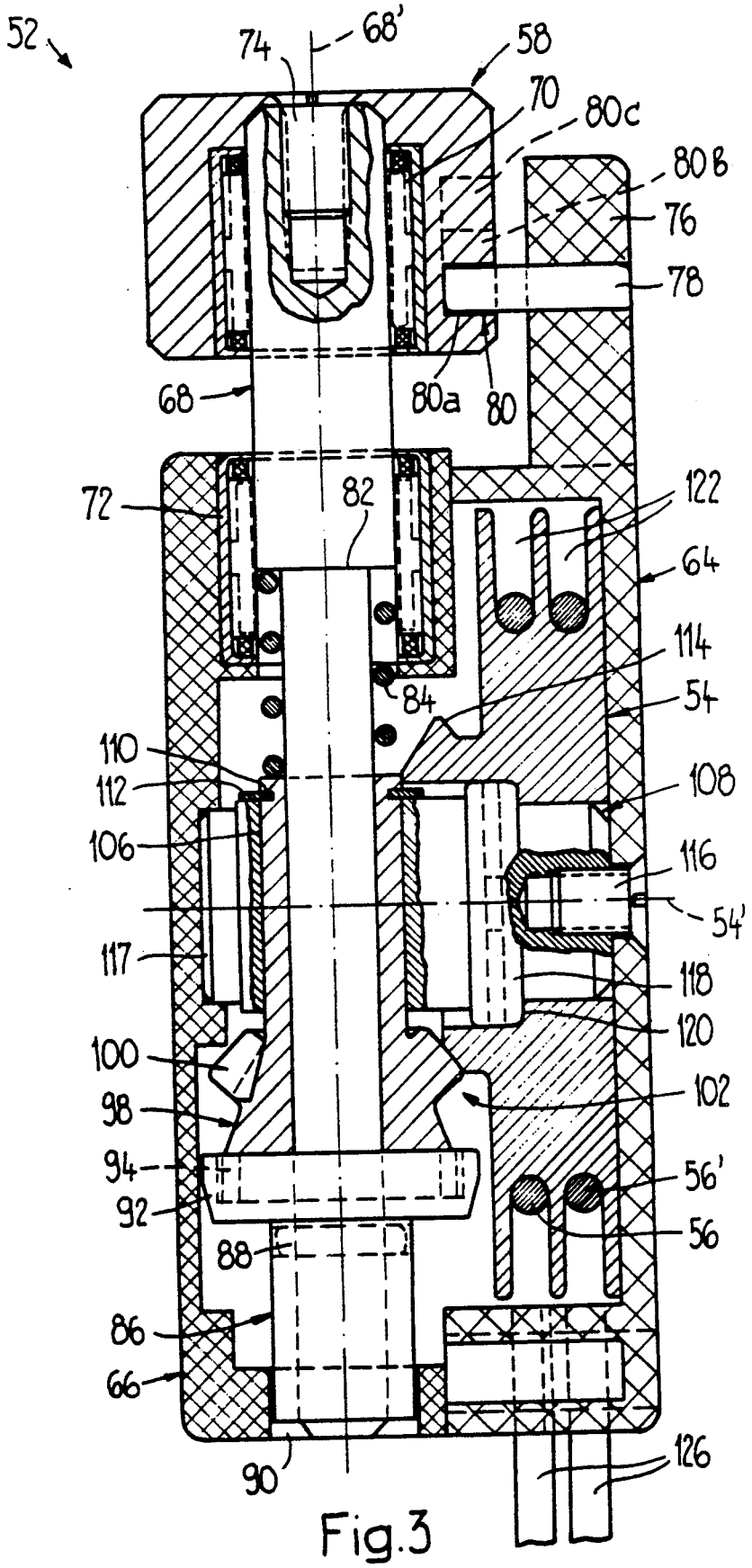
FIG. 3 shows a section view of the clamping device along line 3—3 of FIG. 2.
Figure 4:
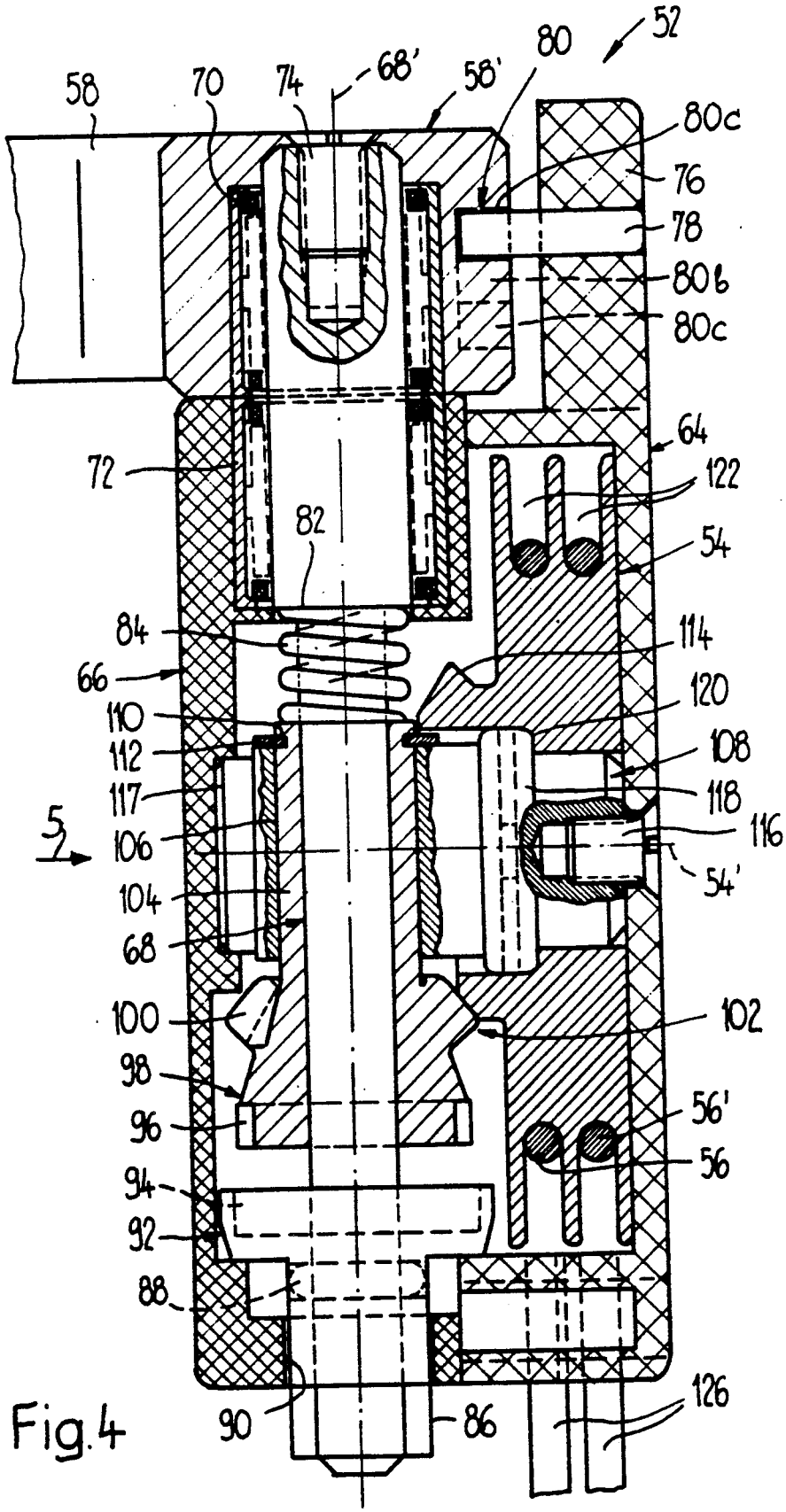
FIG. 4 shows a section view of the clamping device along line 4—4 of FIG. 1.
Figure 5:
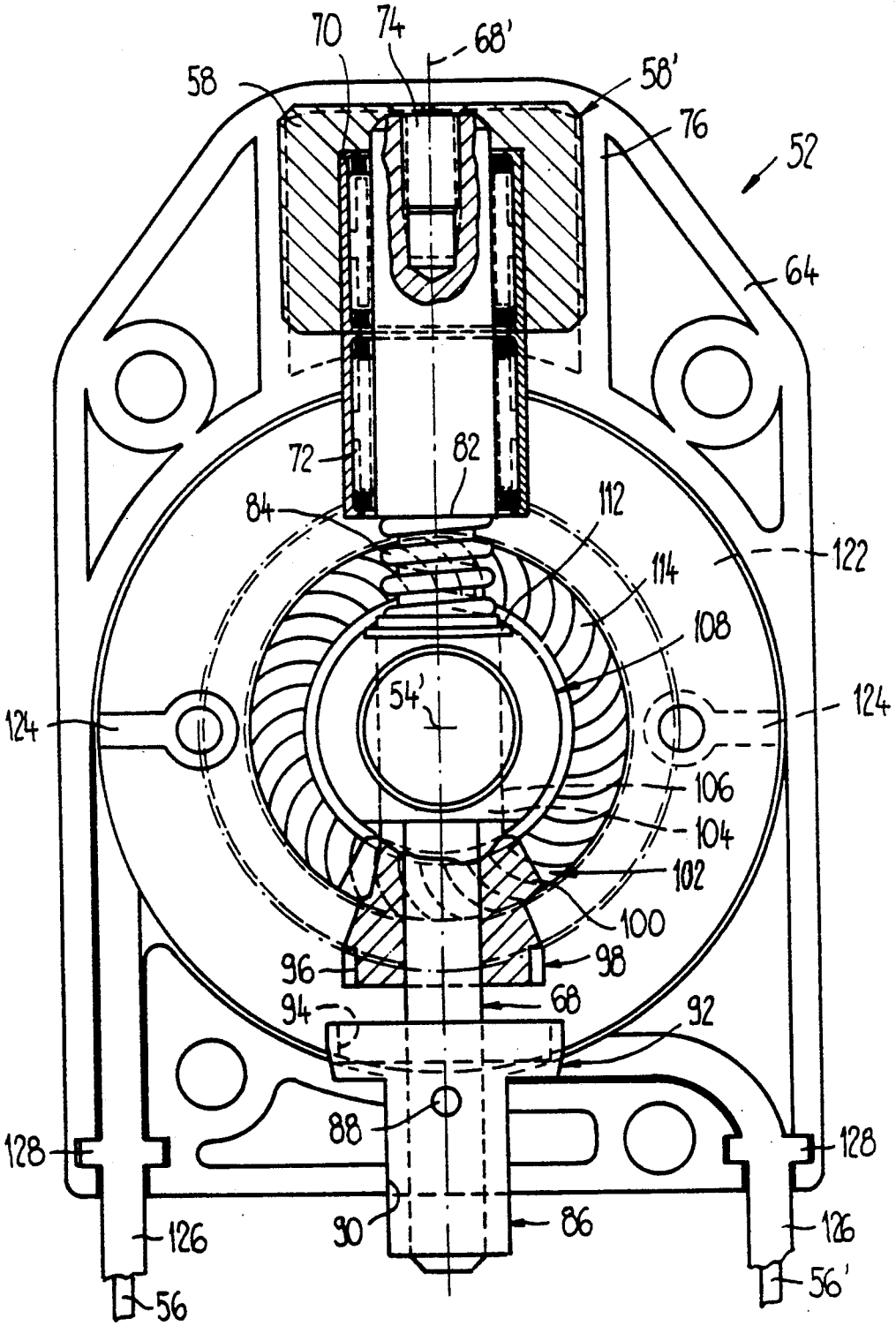
FIG. 5 shows a side view of the clamping device in the direction of arrow 5 of FIG. 4 with the cover 66 removed.

The clamping device 52 illustrated in FIGS. 3 to 5 has a housing part 64 and a cover 66. The clamping device 52 bears with the housing part 64 on the heel part 26 of the ski boot and is fastened to this, for example, by means of screws (not shown). FIGS. 3 and 4 show the clamping device 52 in a section taken along line 3—3 of FIG. 2 or line 4—4 of FIG. 1, respectively. FIG. 5 shows a view of the clamping device 52 in the direction of the arrow 5 of FIG. 4, the cover 66 not being shown.

The actuating element 58 designed as a toggle is arranged on the upper end region of a shank 68, the longitudinal axis 68' of which intercepts the axis of rotation 54' of the winding-up element 54. The longitudinal axis 68' extends approximately in the longitudinal mid-plane of the boot and parallel to the heel part 26, whereas the axis of rotation 54' is essentially at right angles to the heel part 26 (see FIGS. 1 and 2).

Figure 6:
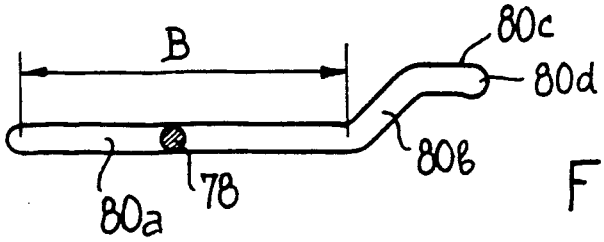
FIG. 6 shows a slot-shaped groove for the actuating element of the clamping device.

The actuating element 58 is connected to the shank 68 via a freewheel sleeve 70 active and rotatable in the clockwise direction. Moreover, the shank 68 is supported on the cover 66 via a further freewheel sleeve 72 active and rotatable in the counterclockwise direction. The shank 68 is, thus, rotatable only in the counterclockwise direction (winding-up direction). By means of a screw 74 extending in the direction of the longitudinal axis 68', the cap-shaped actuating element 58 arranged on the upper end of the shank 68 is fixedly connected to the latter in terms of lifting. The housing part 64 has an extension 76 which projects upwards into the region of the actuating element 58 and on which is fixedly arranged a guide pin 78 projecting towards the actuating element 58. The guide pin 78 engages with its free end region into a slot-shaped groove 80 in the actuating element 58. The layout of the groove 80 is shown in FIG. 6. The groove 80 has a lower groove part 80*a* extending circumferentially in relation to the longitudinal axis 68', an adjoining rising groove part 80*b* and a shorter groove part 80*c* which again extends circumferentially and which, at its end remote from the groove part 80*b*, is limited by a short downwardly directed catch part 80*d*. The lower groove part 80*a* defines a working pivot range B. When the actuating element 58 is pivoted in such a way that the guide pin 78 is located within the working pivot range B, the actuating element 58, together with the shank 68, is lifted into an upper clamping position, as shown in FIG. 3. The actuating element 58 can, thus, be pivoted within the working pivot range B without the shank 68 being lowered in the direction of the longitudinal axis 68'. In contrast, when the actuating element 58 is rotated out of the working pivot range B in the clockwise direction oppositely to the winding-up direction, the rising groove part B runs along the guide pin 78, as a result of which the actuating element 58, together with the shank 68, is displaced downwards in the direction of the longitudinal axis 68'. When the actuating element 58 is rotated in the clockwise direction until the groove part 80*c* is located at the guide pin 78, then the actuating element 58, together with the shank 68, is lowered into the lower release position shown in FIGS. 4 and 5 and designated by 58'. It should be mentioned, in this respect, that the shank 68 is guided in the further or second freewheel sleeve 72 so as to be displaceable in the direction of the longitudinal axis 68', and that the actuating element 58 is freely pivotable in the clockwise direction, without taking up the shaft 68. When the actuating element 58 is rotated until the catch part 80*d* is located at the guide pin 78, then the actuating element 58 is prevented from unintentionally rotating in the counterclockwise direction, since the shank 68 is urged upwards as a result of the force of the compression spring 84 supported at one end on a step 82 of the shank 68, so that the catch part 80*d* is held in the guide pin 78.

In the lower end region of the shank 68, there is arranged on this a sleeve 86 which is fixedly connected to it in terms of rotation and of lifting by means of a peg 88 extending transversely through the sleeve 86 and the shank 68. The sleeve 86 passes through an orifice 90 in the cover 66. A hat-shaped upwardly open coupling part 92 with internal gear teeth 94 is formed in one piece on the sleeve 68 at the upper end. When the shank 68 is in the clamping position, there engages into these internal gear teeth 94 corresponding external gear teeth 96 of a fixedly mounted gearwheel-shaped further coupling part 98, as shown in FIG. 3. When the actuating element 58 is in the release position 58', and consequently, the shank 68 is displaced downwards, the coupling part 92 is moved out of the fixed coupling part 98, as shown in FIGS. 4 and 5.

A bevel wheel 100 of a bevel gear 102 and a tubular shaft part 104 are formed in one piece on the fixed coupling part 98 on the side located opposite the coupling part 92. The shank 68, thus, extends freely rotatably through the coupling part 98, the bevel wheel 100 and the shaft part 104. The shaft part 104 passes through a bore 106 of a journal-like bearing part 108 extending in the direction of the axis of rotation 54' and intended for the winding-up element 54. In the upper free end region, the shaft part 104 has a circumferential groove 110, in which a spring ring 112 is arranged. The spring ring 112 is supported on the bearing part 108 in the direction of the longitudinal axis 68' and keeps the bevel wheel 100 in meshing engagement with a further bevel wheel 114 formed on the winding-up element 54. That end of the compression spring 84 remote from the step 82 of the shank 68 is supported on the upper end of the shaft part 104.

The bearing part 108 is fastened to the housing part 64 by means of a screw 116 extending in the direction of the axis of rotation 54', and at the other end is supported in the cover 66 in a bearing recess 117 in the form of a blind hole. In the middle region between the bore 106 and that end of the shaft part 104 facing the housing part 64, the shaft part 104 has a continuous bead 118 projecting in the radial direction. The drum-shaped winding-up element 54 is arranged in the region between the housing part 64 and the bead 118 freely rotatably on the bearing part 108, the latter being held fixedly in the direction of the axis of rotation 54' by the housing part 64 and a step 120 bearing in the axial direction on the bead 118 and located on the winding-up element 54. The bevel wheel 114 is formed in one piece on the drum-shaped winding-up element 54 and projects relative to the drum-shaped part on the side facing away from the housing part 64.

The winding-up element 54 possesses, in the drum-shaped part, two continuous winding grooves 122 arranged next to one another and each intended for a clamping cable 56, 56' respectively. The width of these winding grooves 122 in the axial direction is only insignificantly larger than the diameter of the clamping cables 56, 56', so that these are guided exactly in the region of the winding-up element 54 and portions of the clamping cables 56, 56' lying on one another are prevented from being jammed against one another. Furthermore, the winding-up element 54 possesses, in the region of the winding grooves 122, diametrically opposed radial slots 124 which are each assigned to a winding groove 122 and which, in their inner end region, as seen in the radial direction, have a widening, in which these ends of the respective clamping cables 56, 56' are held in a known way by means of an end nipple. In the region between the guide orifices 46 (see FIGS. 1 and 2) and the winding grooves 122, the clamping cables 56, 56' are guided in tubular guide sleeves 126. These possess, in the end region on the same side as the clamping device, thickening 128, by means of which they are held in corresponding recesses in the housing part 64.

Figure 7:
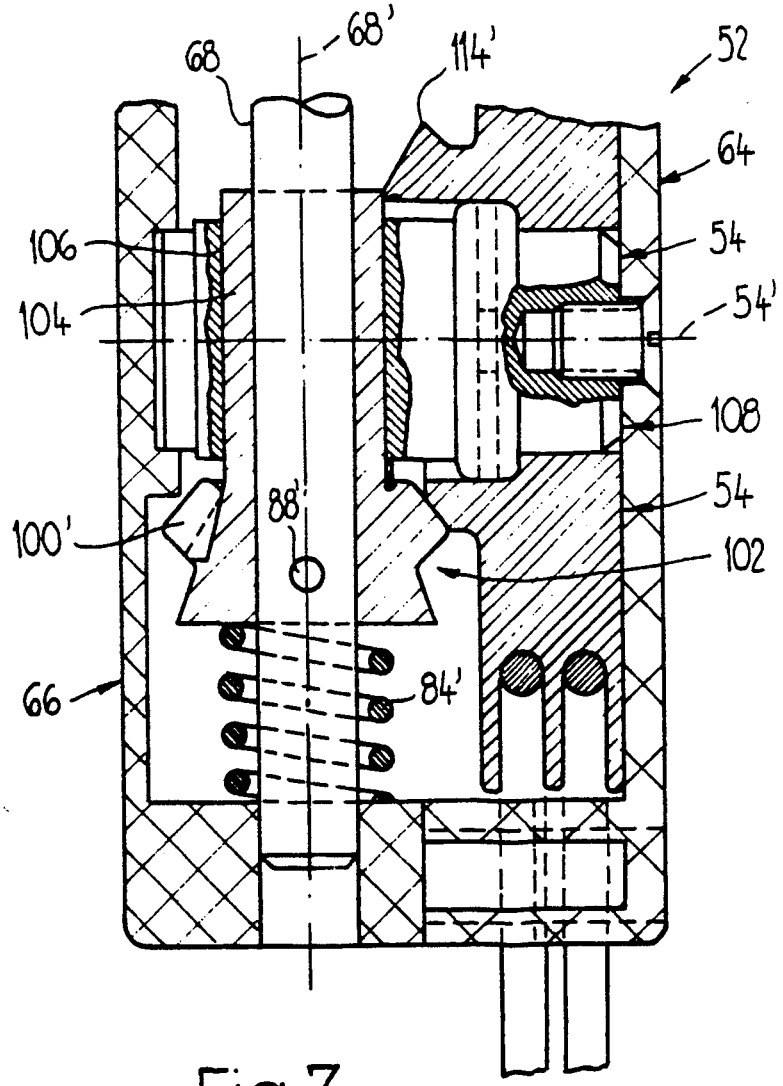
FIG. 7 shows a partial section view of a further embodiment of the clamping device.

FIG. 7 illustrates a clamping device 52 similar to that in FIGS. 3 to 5, but in which the bevel gear 102 itself is designed as a coupling between the shank 68 and the winding-up element 54. Since the guidance of the actuating element 58 on the extension 76 of the housing part 64, the coupling between the actuating element 58 and the shank 68 and the support of the shank 68 on the cover 66 are of a design identical to that of the clamping device 52 illustrated in FIGS. 3 to 5, these parts are not shown again in FIG. 7. The bearing part 108 and the winding-up element 54 mounted freely rotatably on this are also not described in more detail again for the same reasons. The bevel wheel 100' formed in one piece with the tubular shaft part 104 is arranged on the shank 68 and is connected to this fixedly in terms of rotation and of lifting by means of a peg 88'. The shaft part 104 is guided so as to be freely rotatable in the bore 106 and displaceable in the direction of the longitudinal axis 68'. Supported on the bevel wheel 100 is a compression spring 84' which surrounds the shank 68 and which is supported on the other end on the cover 66. This compression spring 84' presses the bevel wheel 100' against the bevel wheel 114' formed on the winding-up element 54. When the actuating element 58 is in the working pivot range B (see FIGS. 3 to 6), the bevel wheel 100' is in the position shown in FIG. 7, in which it meshes with the bevel wheel 114'. In contrast, when the actuating element 58 is pivoted in such a way that the groove part 80c is located at the guide pin 78, as a result of the movement of the shank 68 in the direction of its longitudinal axis 68' the bevel wheel 100' is brought out of engagement with the bevel wheel 114' counter to the force of the compression spring 84'. With the same choice of material for the bevel wheels 100, 114, 100', 114' in the two illustrated embodiments of the clamping device 52, higher tensile forces in the clamping cable 56, 56' are possible in the embodiment according to FIGS. 3–5. This is due to the use of a claw coupling or, as shown in these figures, a gear toothed coupling higher torques can be disconnected in comparison with the intermeshing of the bevel wheels 114, without damaging the respective gear teeth, because, where the latter are concerned, a single toothed flank has to support the entire torque whenever disconnection takes place.

The clamping devices 52 function as follows. With the ski boot opened and the clamping device 52 released, the actuating element 58 is pivoted in the clockwise direction outside the working pivot range B, so that the catch part 80d of the groove 80 is located at the guide pin 78. The shank 68 and the actuating element 58 are lowered into the release position 58', as shown in FIGS. 4 and 5. At the same time, the coupling between the coupling parts 92 and 98, or between the two bevel wheels 100' and 114', according to FIG. 7 is released. The winding-up element 54 is freely rotatable (FIG. 4). For rolling up and tightening the clamping cables 56, 56', the actuating element 58 is now pivoted in the counterclockwise direction (winding-up direction) out of the catch part 80d into the working pivot range B (see FIG. 6). The actuating element 58, together with the shank 68, thus moves into the upper clamping position according to FIGS. 3 and 7. At the same time, the two coupling parts 92, 98 or the two bevel wheels 100', 114' come into engagement with one another. By pivoting the actuating element 58 to and fro within the working pivot range B, the shank 68 is now taken up whenever the actuating element 58 is rotated counterclockwise in the winding-up direction. The rotation of the shank 68 produced thereby is transmitted to the winding-up element 54 via the bevel gear 102, with the result that the clamping cables 56, 56' are wound up intermittently in each case (FIG. 3). The freewheel sleeve 72, at the same time, prevents the shank 68 from rotating in the clockwise direction and, thus, also prevents the clamping cables 56, 56' from unwinding from the winding-up element 54. By an appropriate pivoting of the actuating element 58, the desired tensile force can now be built up continuously in the clamping cables 56, 56'. As soon as the desired tensile force is reached in the clamping cables 56, 56', that is to say as soon as the ski boot according to FIGS. 1 and 2 rests flush against the foot, the actuating element 58 is left in the particular position.

When the clamping cables 56, 56' have to be loosened, the actuating element 58 is briefly pivoted clockwise in the opposite direction to the winding-up direction, so that the two coupling parts 92, 98 or bevel wheels 100', 114' (FIG. 7) briefly come out of engagement (FIG. 4). By means of the tensile force in the clamping cables 56, 56', these are now unwound partially from the winding-up element 54. By subsequently pivoting the actuating element 58 back into the working pivot range B, the winding up element 54 is blocked again. To open the ski boot, the actuating element 58 is pivoted out of the working pivot range B, in such a way that the groove part 80c, or the catch part 80d, comes to rest at the guide pin 78. The winding-up element 54 is, thus, released in a similar way, so that by pivoting the tongue part 28 forwards (see FIGS. 1 and 2) the clamping cables 56, 56' can then be unwound to the necessary length from the winding-up element 54.

With the clamping devices 52 shown in FIGS. 3 to 7, winding-up elements 54 of large diameter can be accommodated in a small housing part 64 with a cover 66. The result of this is that long lengths of clamping cables 56, 56' can be wound up by means of only a few revolutions of the winding-up element 54. Nevertheless, high tensile forces can easily be obtained in the clamping cables 56, 56' as a result of the constant force/path relations and the ergonomic arrangement of the actuating element 58. Only a single actuating element 58 is needed for the tensioning and quick release of the clamping device 52, and this considerably increases the ease of operation.

It is also possible to wind up the two end portions of the same cable-like clamping element in the two winding grooves. Of course, the clamping device according to the invention can also be used for actuating foot retaining devices provided inside the ski boot.

While only two embodiments of the present invention has been shown and described, it is to be understood that many changes and modifications may be made thereunto without departing from the spirit and scope of the invention as defined in the appended claims.

What is claimed is:

1. A clamping device for a ski boot comprising:

a clamping element;

a rotatably mounted winding-up element for the winding-up and unwinding of said clamping element;

an actuating element pivotable to and fro within a working pivot range for the intermittent driving of the winding-up element in the winding-up direction;

a take-up connection rotatable in the winding-up direction for connecting said actuating element to a transmission member;

a return catch device for preventing said transmission member from rotating oppositely to the winding-up direction;

a coupling for connecting the transmission member to the winding-up element and controllable as a result of the displacement of the transmission member;

said transmission member being displaceable as a result of a pivoting of the actuating member for the purpose of releasing the coupling;

a slotted control;

said actuating element during the pivoting out of the working pivot range oppositely to the winding-up direction, is movable by said slotted control in the direction of its pivot axis; and said transmission member being displaceable as a result of this movement oppositely to the winding-up direction for the release of the coupling.

2. The clamping device as claimed in claim 1, wherein the return catch device has a freewheel active in the winding-up direction.

3. The clamping device as claimed in claim 1, wherein the coupling is releasable as a result of the displacement of the transmission member in its axial direction.

4. The clamping device as claimed in claim 3, comprising a first coupling part fixedly located on the transmission member in terms of rotation and displacement;

a second coupling part connected to the winding-up element and is rotatably mounted to the winding-up element at a fixed location;

a spring element acting on the transmission member;

said first coupling part pressed against the second coupling part due to the force of said spring element; and said transmission member being displaceable counter to the force of the spring element for releasing the coupling.

5. The clamping device as claimed in claim 4, wherein the first and second coupling parts are parts of a claw coupling.

6. The clamping device as claimed in claim 4, wherein the transmission member has a longitudinal axis;

wherein the winding-up element has an axis of rotation;

wherein the longitudinal axis of the transmission member and the axis of rotation of the winding-up element intersect one another approximately at right angles;

said second coupling part is located freely rotatably on the transmission member; and a bevel gear for connecting said second coupling part to the winding-up element.

7. The clamping device as claimed in claim 6, wherein said ski boot has a shell;

wherein the axis of the transmission member extends essentially parallel to the ski boot shell; and wherein the actuating element comprises a toggle.

8. The clamping device as claimed in claim 1, wherein the actuating element is located on the transmission member; and a second freewheel active oppositely to the winding-up direction for connecting said actuating element to said transmission member.

9. The clamping device as claimed in claim 1, wherein the actuating element is connected to the transmission member with a lifting effect.

10. The clamping device as claimed in claim 1, wherein said winding-up element further comprises two winding-up grooves for the two end regions of a single clamping element, connected at the other end to a part of a ski-boot.

* * * * *